US009764809B2

(12) United States Patent
Arienti et al.

(10) Patent No.: US 9,764,809 B2
(45) Date of Patent: Sep. 19, 2017

(54) UNDERWATER PROPELLER DEVICE WITH PULSED JETS

(71) Applicant: SCUOLA SUPERIORE DI STUDI UNIVERSITARI E DI PERFEZIONAMENTO SANT'ANNA, Pisa (IT)

(72) Inventors: Andrea Arienti, Livorno (IT); Francesco Giorgio Serchi, Livorno (IT)

(73) Assignee: SCUOLA SUPERIORE DI STUDI UNIVERSITARI E DI PERFEZIONAMENTO SANT'ANNA, Pisa (IT)

( * ) Notice: Subject to any disclaimer, the term of this patent is extended or adjusted under 35 U.S.C. 154(b) by 313 days.

(21) Appl. No.: 14/396,354

(22) PCT Filed: Apr. 16, 2013

(86) PCT No.: PCT/IB2013/053014
§ 371 (c)(1),
(2) Date: Oct. 22, 2014

(87) PCT Pub. No.: WO2013/160801
PCT Pub. Date: Oct. 31, 2013

(65) Prior Publication Data

US 2015/0086364 A1 Mar. 26, 2015

(30) Foreign Application Priority Data

Apr. 23, 2012 (IT) ..... FI2012A0082

(51) Int. Cl.
*B63H 25/00* (2006.01)
*B63H 11/00* (2006.01)
(Continued)

(52) U.S. Cl.
CPC ..... *B63H 11/00* (2013.01); *B63H 1/04* (2013.01); *B63H 11/06* (2013.01); *B63H 21/12* (2013.01); *B63H 25/00* (2013.01)

(58) Field of Classification Search
CPC ..... B63H 11/06
See application file for complete search history.

(56) References Cited

U.S. PATENT DOCUMENTS 3,154,043 A 10/1964 Momsen, Jr.
5,607,331 A * 3/1997 Lekhtman ..... B63H 11/06 440/23

(Continued)

FOREIGN PATENT DOCUMENTS

CN 201712781 1/2011
FR 2470875 6/1981

OTHER PUBLICATIONS

PCT International Search Report mailed on Jun. 28, 2013 for PCT Application PCT/IB2013/053014 filed on Apr. 16, 2013 in the name of Scuola Superiore Di Studi Universitari E Di . . . .

(Continued)

*Primary Examiner* — Edwin Swinehart
(74) *Attorney, Agent, or Firm* — Steinfl + Bruno LLP

(57) ABSTRACT

A device, which is autonomous or which can be associated with another structure, for propulsion in a liquid environment, is described. The device has a bladder body made of a soft material, developing along and around a central longitudinal axis, defining an internal chamber between a dorsal wall and a ventral wall; in the bladder body, an inlet opening and an outlet opening of a liquid in and out of the chamber, arranged at a longitudinal end of the body; and drive means for driving a contraction of the bladder, arranged on the dorsal wall and having a mechanical connection with the ventral to cyclically attract the ventral wall (Continued)

to the dorsal wall, thereby causing a pulsed ejection of a propeller jet from the chamber through the outlet opening.

15 Claims, 5 Drawing Sheets

(51) Int. Cl.

| | |
|---|---|
| ***B63H 1/04*** | (2006.01) |
| ***B63H 21/12*** | (2006.01) |
| ***B63H 11/06*** | (2006.01) |

(56) References Cited

U.S. PATENT DOCUMENTS

| | | | | |
|---|---|---|---|---|
| 6,607,368 | B1 * | 8/2003 | Ross | A61M 1/1037 417/412 |
| 2004/0121664 | A1 * | 6/2004 | Hassan | F04B 17/044 440/38 |

OTHER PUBLICATIONS

PCT Written Opinion mailed on Jun. 28, 2013 for PCT Application PCT/IB2013/053014 filed on Apr. 16, 2013 in the name of Scuola Superiore Di Studi Universitari E Di . . . .

Wang, Y. et al. "Novel design for a biomimetic water-jetting propulsion vehicle actuated by SMA wires." Applied Mechanics and Materials. vol. 50-51, 2011, pp. 73-77.

Krieg, M. et al. "Thrust Characterization of a Bioinspired Vortex Ring Thruster for Locomotion of Underwater Robots." IEEE Journal of Oceanic Engineering. vol. 33(2), Apr. 2008, pp. 123-132.

* cited by examiner

UNDERWATER PROPELLER DEVICE WITH PULSED JETS

CROSS REFERENCE TO RELATED APPLICATIONS

The present application is the US national stage of International Patent Application PCT/IB2013/053014 filed on Apr. 16, 2013 which, in turn, claims priority to Italian Patent Application FI2012A000082 filed on Apr. 23, 2012.

TECHNICAL FIELD OF THE INVENTION

The present invention refers to a device, which can be autonomous or associated with another structure, for propulsion in a liquid environment, which can be used in many fields, from underwater exploration to checking on and maintaining equipment, to mini-invasive surgery.

BACKGROUND OF THE INVENTION

The prior art foresees examples of devices or actual underwater robots, with pulsed jet propulsion and inspired by biomimetics. Amongst these, the device described in patent publications U.S. Pat. No. 3,154,043 and CN201712781, and the craft described in Yangwei Wang, et al.: *Novel design for a biomimetic water-jetting propulsion vehicle actuated by SMA wires*, Applied Mechanics and Materials, vol. 50-51, 2011, pp.73-77. The latter in particular replicates the propulsion system of a squid, foreseeing a semi-cylindrical mantle made from flexible material such as silicone gel, defining, in diametrical cooperation with a rigid shell, a cavity with an inlet opening and an outlet nozzle of the liquid in the axial direction. A framework of semi-rigid supports embeds the mantle along respective generatrices, and therefore in an axial/longitudinal direction.

The contraction and the expansion of the mantle, resulting in the ejection of pulsed jets for the propulsion from the aforementioned nozzle, is managed by wires made of SMA (Shape Memory Alloy) which extend over the mantle between the semi-rigid supports in a circumferential direction. The activation of the SMA wires by means of electric heating induces a contraction thereof and thus a movement of the supports that comes together with a consequent reduction of the inner volume of the mantle. The deactivation of the wires allows, on the other hand, the mantle to expand again, drawing the fluid inside the cavity through the inlet opening. The rigid diametrical shell, which also represents a structural element of the craft, houses the system for controlling and electrically urging the SMA wires.

The invasive presence of rigid or semi-rigid components is an element that strongly limits the craft/device described above, thus leading to the possibility of damaging the device itself and of the surrounding environment, and to a lower intrinsic safety that deters its use and operation in the vicinity of people and animals. It moreover penalises the manoeuvrability, making the structure heavier and less hydrodynamic. At the expense of the manoeuvrability there is also the SMA wire actuation system, which is abrupt and thus makes the movement markedly discontinuous and more difficult to control.

SUMMARY OF THE INVENTION

The purpose of the present invention is to provide an underwater propeller device with pulsed jets, which firstly limits the drawbacks highlighted above due to the presence of rigid or semi-rigid components.

A particular purpose of the present invention is that of providing a device of the type mentioned above, having a structure that is particularly light and hydrodynamic.

A further particular purpose of the present invention is that of providing a device of the aforementioned type, which allows a movement that is relatively continuous and easy to control.

These and other purposes are achieved with the device according to the present invention, the essential characteristics of which are defined in the first of the attached claims. Further important characteristics are defined by the dependent claims.

In terms of its structure the device according to the invention has complete flexibility, since it is totally without a rigid endo- or exoskeleton. This places the proposed product in line with new design principles of Soft Robotics and in contrast to currently existing products essentially made up of joints and rigid parts, based on conventional principles of mechanics and robotics. In terms of its operation, the propulsive principle of the present invention exploits the propulsion with discontinuous jets with ring-shaped vortices, capable of offering considerable advantages in terms of efficiency with respect to the more conventional propeller systems.

The device according to the present invention, thanks in particular to the innovative characteristics of its actuation system, thus actually creates a continuous structure that is overall yieldable, with extremely limited rigid constraints.

The fundamentally "soft" nature of the device and the continuity of its actuation, as well as the exploitation of the passive properties of the materials, derive firstly from a particularly functional control and rational use of the forces in play inside the structure. But, more in general, the following advantages can be listed:

- limited possibility of the device itself and of the surrounding environment of being damaged;
- enhanced intrinsic safety which makes it possible to operate in the vicinity of people or animals;
- high manoeuvrability;
- possibility of being inserted in modular structures that raise the overall propulsion capability;
- lightness and hydrodynamic properties.

By exploiting the characteristics of the material themselves (silicone gel or similar) which form most of the device, it is possible to obtain high performance in terms of manoeuvrability and propulsion efficiency, without however requiring an onerous actuation and control (in weight, bulk, complexity). It is also possible to achieve a wide scalability of the device without having to alter its main characteristics. Indeed, by following the same conceptual approach, it is possible to make miniaturised devices (maximum dimensions of the order of few cm), big devices or even macroscopic devices.

BRIEF DESCRIPTION OF THE DRAWINGS

The characteristics and the advantages of the underwater propeller device with pulsed jets according to the present invention shall become clearer from the following description of an embodiment thereof given as an example and not for limiting purposes with reference to the attached drawings in which.

DETAILED DESCRIPTION OF THE INVENTION

Figure 1:
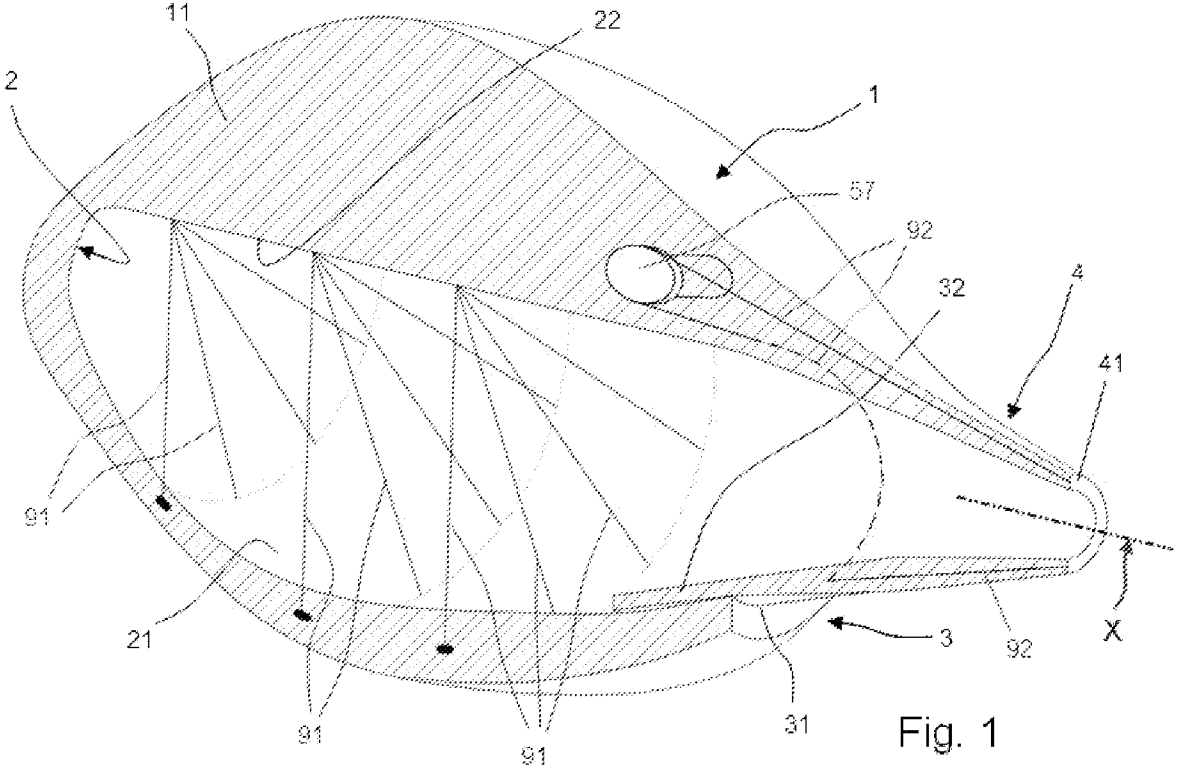
FIG. 1 is a sectioned schematic view of a device according to the invention, with parts that have been removed for the sake of clarity.

With reference to said figures, a device according to the invention comprises a bladder body 1 made of soft material and preferably having generically elastic or viscoelastic behaviour (i.e. natural tendency to return to an unwarped configuration). Viscoelastic materials can be used such as silicone rubber, elastomers with viscoelastic properties that are similar to those of silicone or in general other polymers with low Young's modulus (of the order of some tens of kPa and in any case lower than 100 kPa) which can undergo big deformations (greater than 500%) without suffering permanent deformations.

The bladder 1 has an elongated shape, advantageously egg-shaped developing along and around a central longitudinal axis X, which as shall be seen also defines the propulsion direction. Inside, the bladder 1 defines a chamber 2 that is open towards the outside by a siphon 4 ending in an outlet nozzle 41, in the shape of a cylindrical portion or preferably frustoconical arranged at a longitudinal end and coaxial to the axis X, so as to produce an ejection of liquid along the aforementioned axis (when not oriented so as to control the direction of the movement, according to what will be described in the rest of the description).

Figure 4A:
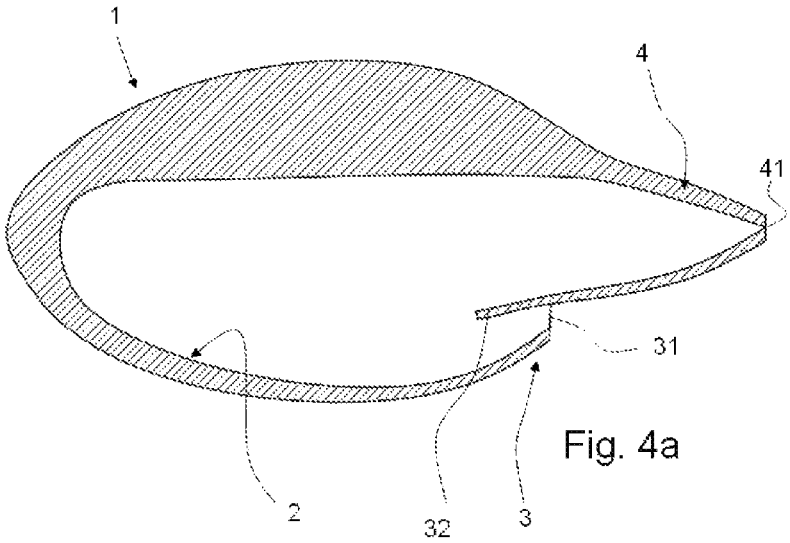
FIGS. 4*a* and 4*b* are schematic views of the device in a longitudinal section, with parts removed, emphasising conditions that correspond to the steps of FIG. 3*a* and FIG. 3*b*, respectively.
Figure 4B:
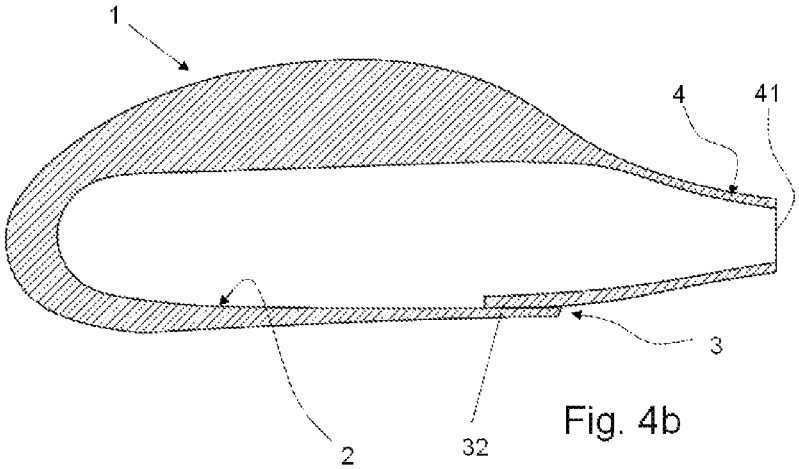

An inlet opening of the fluid inside the chamber 2 is, on the other hand, supplied by a valve 3, formed by a fracture 31 of the bladder extending circumferentially at the base of the siphon 4. A skirt 32 moreover extends from such a base, said skirt penetrating the chamber 2 so as to be adapted to intercept the fracture 31 internally overlapping the adjacent bladder wall portion 1. Such an overlapping (with shutting of the fracture 31 and consequent closure of the valve) is in particular ensured by effect of a contraction of the bladder 1 (FIG. 4*b*), which results in the ejection of the fluid from the chamber 2, whereas in an expanded or unwarped configuration of the bladder the skirt 32 is adapted to lift passively towards the inside freeing the inlet passage of the fluid, in which condition the nozzle 41 of the siphon 4, on the other hand, tends to close (see in particular FIG. 4*a*).

On the inner surface that defines the chamber 2, two regions that are opposite one another with respect to the axis X can be identified, and precisely a ventral region 21, on which the valve 3 opens, and a dorsal region 22 at which the bladder has a thickened dorsal wall 11.

Figure 2:
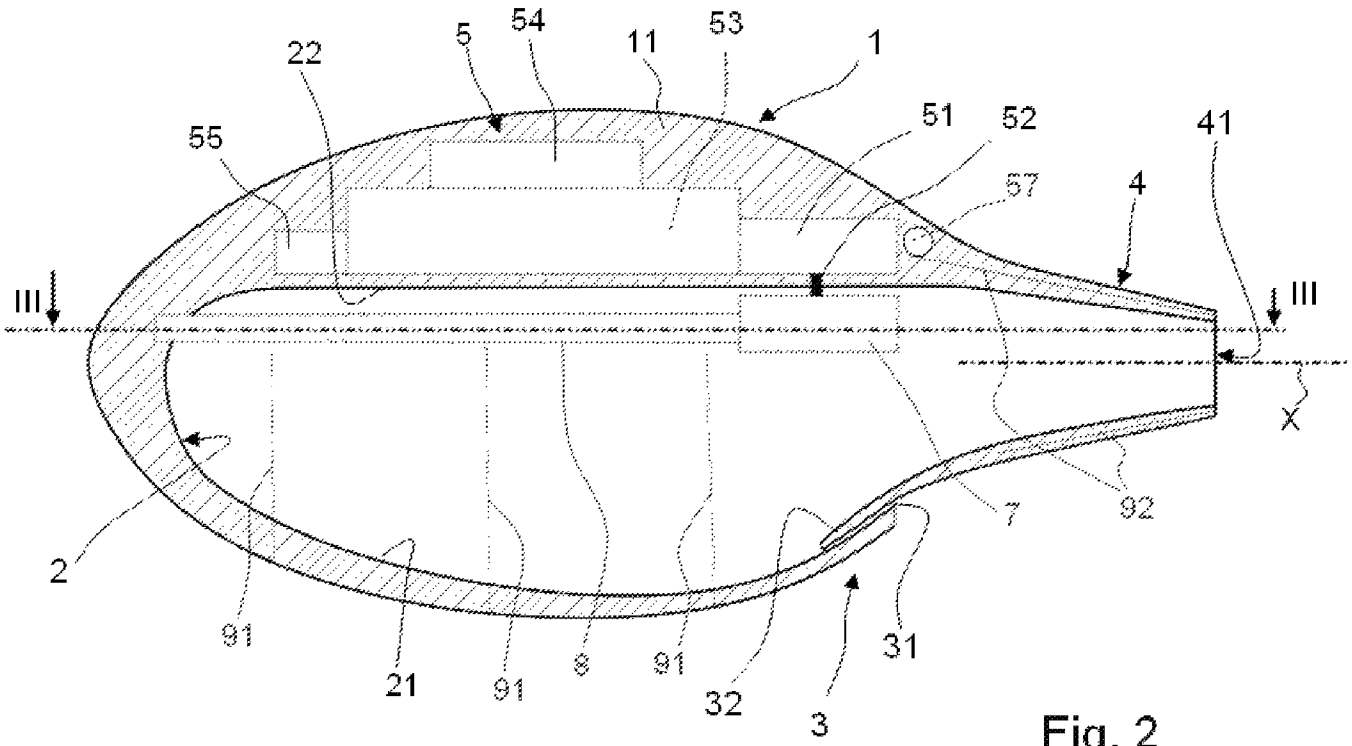
FIG. 2 is a schematic section view of the device of FIG. 1 carried out along the sagittal or longitudinal plane.

Means 5 for driving the contraction of the bladder, and with it the propulsion, comprise according to the invention (FIG. 2) a motor 51 embedded in the dorsal wall 11 near to the siphon 4, adapted to bring into rotation a shaft 52 projecting inside the chamber 2 through the dorsal region 22 over a normal plane with respect to the longitudinal axis X. The motor 51 is supplied by batteries 53 and is controlled by a control unit with microprocessor 54 that is associated with a sensor system 55, all these components being in turn housed by the dorsal wall 11. The control unit can autonomously manage the device based on preset instructions and indeed with the aid of said sensor system, or (or in addition) be equipped with reception/transmission means for a remote management, all according to what can be implemented by a person skilled in the art.

Figure 3B:
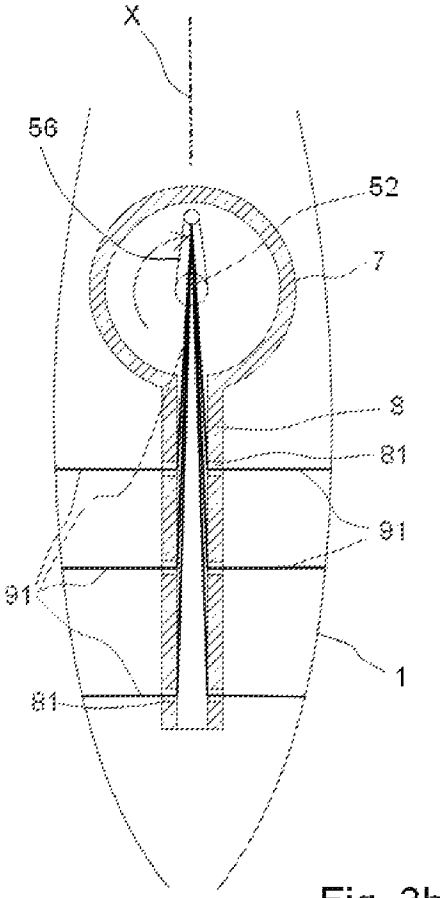
FIGS. 3*a* and 3*b* represent schematic section views of the device according to the arrows III-III of FIG. 2, in an expansion step and in a contraction step, respectively.
Figure 3A:
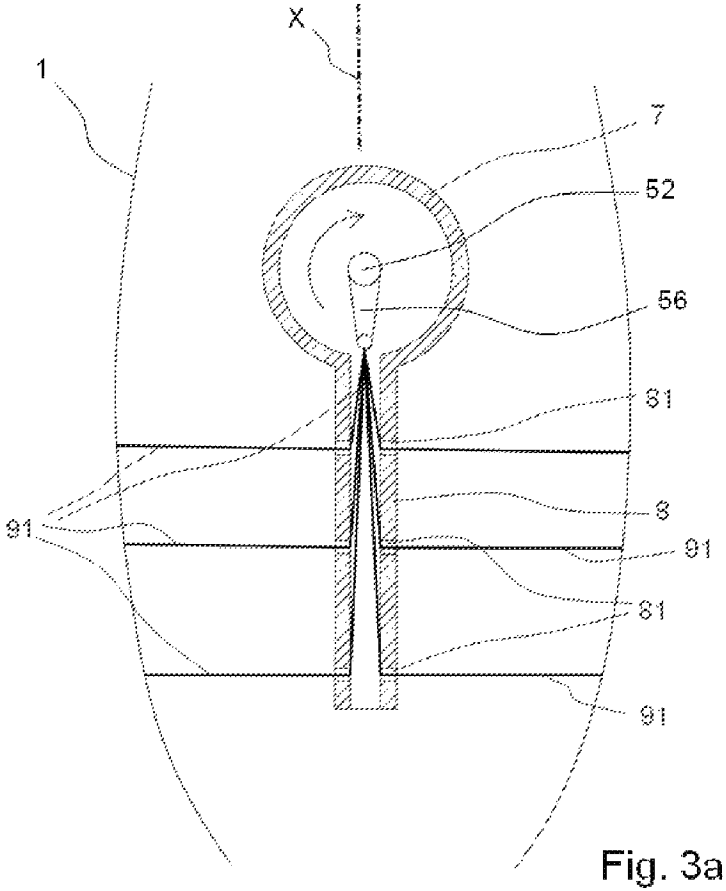

The shaft 52, indeed inside the chamber 2, sets a crank 56 in rotation, said crank being arranged inside a protective case 7, from which a tubular guide 8 longitudinally extends, running along the entire development of the chamber. The tubular guide 8 has (FIGS. 3*a* and 3*b*) an organised distribution of holes 81 through which respective flexible and inextensible wires 91 pass each having one end connected to the distal end of the crank 56, and the other end anchored to a different point of the ventral portion 22. A bundle of wires or tie-strings 91 thus spreads away from the crank 56 and runs along the tubular guide 8, with the wires that spread away from the bundle at different distances, in arrays that branch off spreading towards the belly of the bladder, distributed from one another and spaced along the axis X so as to involve a substantial portion of the extension of the bladder, both with the longitudinal development and with the circumferential development of the belly. In the example three arrays can be seen each made up of four wires 91.

Figure 5B:
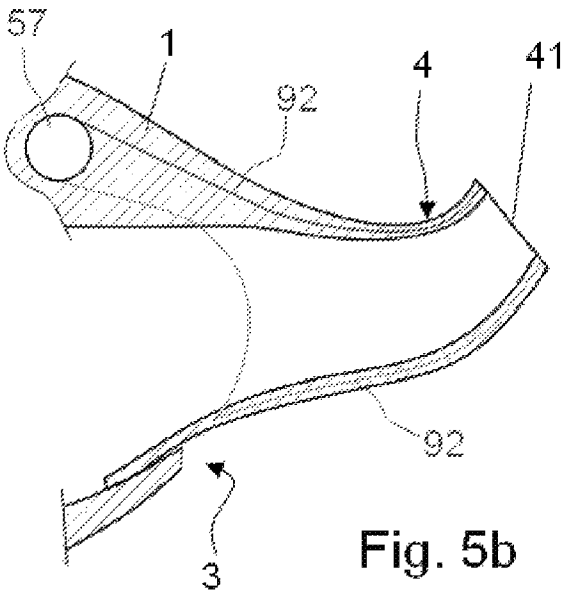
FIGS. 5*a* and 5*b* are longitudinal section views of a siphon propeller of the device, in two different orientations.
Figure 5A:
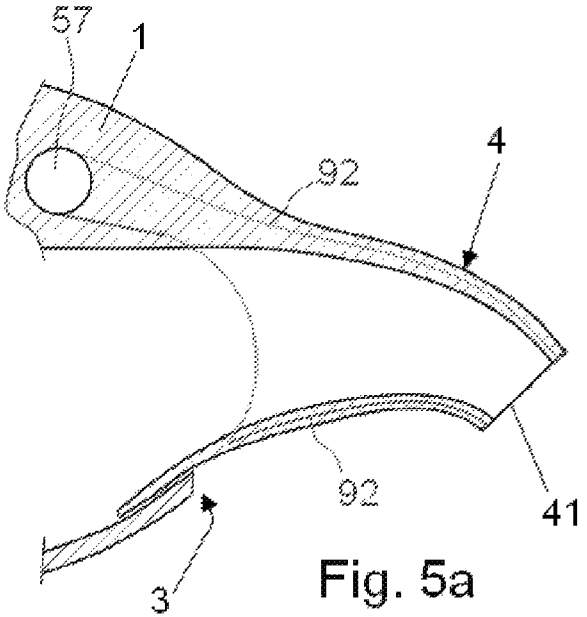

A further and independent steering motor 57, again supplied by the batteries 53, is arranged in the dorsal wall 1 at the base of the siphon 4, practically in a position that is diametrically opposite the valve 3. The steering motor 57, or more accurately an outlet pulley thereof (FIGS. 5*a* and 5*b*) controls two tie-strings 92 that extend, in this case, over the siphon 4, embedded in its walls, along two diametrically opposite generatrices, in one case passing by a circumferential connection arm. The rotation of the motor 57 induces the return of one or the other of the two tie-strings connected to it and anchored at the end of the siphon, so as to induce the deformation thereof onto it, and consequently a change in the orientation on the involved diametrical plane. An identical system, not shown, operates on a diametrical plane at 90° with respect to the previous one, whereby the coordinated actuation of the two systems makes it possible to obtain a wide spectrum of orientations in space, comprising a configuration with the nozzle 41 that is turned back towards the bladder 1 for a reverse movement.

In terms of its operation, the jet propulsion according to the invention is made by cyclical repetition of contraction steps of the bladder 1 with the expulsion of fluid (FIG. 4*b*) and subsequent expansions with the filling up of the inner chamber 2 thanks to the opening of the valve 3. At the compression step it provides for the actuation of the crank that moves the common joint of the wires 91 away from the relative anchoring points of the belly of the bladder (position of FIG. 3*b*), causing the return of the belly itself in the radial direction with respect to the dorsal wall 11 and the pressurization of the fluid contained in the chamber 2. Thanks to the configuration of the tubular guide 8 the traction exerted by the various tie-strings 91 is substantially even.

To a rotation angle of the crank 56 equal to 180° with respect to the previous one, corresponds moreover a release of the tie-strings (FIG. 3*a*) with consequent expansion of the bladder, which is completely passive due to the elastic nature of the material, just as the opening of the valve 3 is also passive for lifting the skirt 32 and returning the fluid by depression from the surrounding environment inside the chamber. The load exerted by the anchoring points of the wires to the ventral wall indeed leads to the distribution of stress inside the material, which are freed when the tension on the wires stops and that tend to spontaneously bring the wall of the bladder back to the undeformed state. The velocity with which the fluid environment is drawn through the inlet valve 3 is a function of the greater or smaller incidence of the elastic component with respect to the viscous component, which can be optimised by operating on the nature of the material, on the thickness of the walls of the bladder and on its geometry. The contraction can possibly be assisted by supplementary actuator means, that operate in contrast with respect to the contraction actuation controlled by the motor system, not foreseen in this embodiment but that is in any case obvious to implement.

For every rotation of the crank 56 there is thus a corresponding half a rotation in which the tie-strings are pulled, and half a rotation in which they are released. In the design stage, in order to adapt the volume undergoing pressurisation, and the power of the ejection jet, to the specific requirements, it is obviously possible to operate on various structural and dimensional parameters, such as, in particular, the length of the crank, the thickness of the ventral wall of the bladder, the material used, the same geometry of the bladder (with possible presence of inner walls), the number of wires and the position in which they are anchored to the belly, the configuration of the guide and of the relative holes, the power of the motor and the characteristics of its dispensing etc.

In the contraction/ejection step, the fluid in outlet is accelerated through the siphon 4. In such a way, a jet with a finite volume is ejected in an impulsive or semi-impulsive fashion through the nozzle 41, downstream of which the expelled volume naturally gives life to a vortex ring. The propulsion with discontinuous jets, in particular if associated with the generation of vortex rings, offers two very significant advantages with respect to conventional propeller propulsion, i.e. greater efficiency and a shorter response time in transferring the thrust from the fluid to the propelled body. In this type of propulsion, indeed, the thrust generated is transferred in a percentage of about 80% in a time of five tenths of a second, in contrast with a continuous jet like that generated by a propeller in which the response time is longer (concerning this see for example Krieg, Mohseni, *Thrust Characterization of a Bioinspired Vortex Ring Thruster for Locomotion of Underwater Robots*, IEEE Journal of Oceanic Engineering, VOL 33, April 2008, No. 2).

In each diametrically opposite pair, to the pulling of a wire (lower wire in the condition of FIG. 5*a*, upper wire in the condition of FIG. 5*b*) corresponds the relaxation of its antagonist wire. In this way by orienting the siphon, the device is capable of carrying out turns and it is generally easy to manoeuvre, also due to the impulsive nature of the generated thrust. In the modality of almost stationary navigation, i.e. when the pulsing is constant, it is possible to produce a moment on the device by simply varying the orientation of the siphon by a few degrees with respect to the resting configuration, configuration in which the central axis of symmetry of the siphon itself coincides with the central axis X of the bladder 1. This can be carried out without requiring variations in the pulsing, similarly to conventional underwater propelling systems.

The mechanism given as an example allows the device moreover to carry out turning manoeuvres inside radii of curvature that are very small. Indeed, by associating a pronounced bending of the siphon to a suitable pulsation of the jet it is indeed possible to generate a moment that is capable of moving the bladder on itself. The possibility of carrying out impulsive accelerations with a short duration in different directions thus makes it possible to exert a fine control on the navigation of the device. One interesting prerogative of the aforementioned steering mechanism consists of the possibility of orienting the siphon by turning the nozzle to the front, i.e. towards the opposite longitudinal end of the bladder and thus in the direction that corresponds to the direct navigation motion, exerting a bending of 180° with respect to the resting configuration. This makes it possible to both produce noticeable decelerations, and to navigate with a reverse movement without needing further appendages or actuators.

The device according to the invention is in conclusion extremely indicated for underwater activity in many different fields, since it is suitable for operating in small spaces and since it is made up of a structure that is minimally rigidified by the particular actuation system defined, and thus capable of being compressed and of adapting to the surrounding environment, without producing impacts of a critical nature. Such characteristics and the other accessories highlighted above make the device suitable for carrying out tasks both in the industrial field and in service robotics. Since, for the materials used, the device is suitable for taking up a hydrostatic configuration that is substantially neutral, there are clear advantages for underwater use, even as integrations with underwater robotic platforms (Autonomous Underwater Vehicle—AUV), but also on ROVs (Remotely Operated Vehicle) specialised in underwater manipulation.

The extreme lightness and softness makes the device potentially useful also for space applications, where weight, bulk, and risk of being damaged, are crucial factors. For the deformability of the materials used, the present invention can be used in all the industrial fields in which it is fundamental to have a mechanically yieldable structure and to be capable of moving with dexterity and delicately, like handling artefacts in underwater archaeology or in mini-invasive surgery. Again, the present invention can find use in fields such as maintenance of underwater structures (for example underwater petrol pipelines), navigation in muddy waters (for example in ports), fish farming, underwater speleology and scientific exploration.

The possibility of the bladder 1 contracting itself makes the present invention very suitable for all those environments that are difficult to reach from very small inlets, in which however there is the requirement of great mobility, like in cleaning pipelines, silos, tanks and reservoirs or in the removal of ruins or searching for people in areas affected by natural disasters. These possible uses, of course, are only some and all relate to the use of the present invention as described, but it can be easily equipped with numerous specific components, soft or rigid, for carrying out more specific tasks. For this purpose, it should be noted how the device can be made so as to form an operative robotic apparatus itself that is self-sufficient, with the suitable equipment mounted for example on the dorsal wall of the body 1, or, keeping its configuration substantially as described above, be mechanically associated with an external structure/apparatus of which it will act as propulsion means, or again incorporated in a complex structure, again with the same function.

The present invention has been described with reference to a preferred embodiment thereof. It should be understood that other embodiments may exist belonging to the same inventive core, all covered by the scope of protection of the following claims.

The invention claimed is:

1. An underwater propeller device comprising:

a bladder body completely made of a soft material, developing along and around a central longitudinal axis, defining an internal chamber between a dorsal wall and a ventral wall;

in said bladder body, an inlet opening and an outlet opening of a liquid in and out of said chamber, arranged at a longitudinal end of the body; and drive means for driving a contraction of said bladder, arranged on said dorsal wall and comprising a mechanical connection with said ventral wall to cyclically attract the ventral wall to the dorsal wall, thereby causing a pulsed ejection of a propeller jet from said chamber through said outlet opening.

2. The device according to claim 1, wherein said drive means comprise a distribution of flexible and inextensible wires anchored at respective ends to different points of said ventral wall and pulled by motor means arranged on, or associated with, said dorsal wall.

3. The device according to claim 2, wherein said motor means comprise a motor adapted to bring into rotation a shaft projecting inside said chamber over a normal plane to said longitudinal axis in proximity to said outlet opening, said shaft driving in turn a crank, to the free end of which the ends of the wires opposite the ventral anchoring end are connected, wire guide means being further provided, extending longitudinally in proximity to said dorsal wall and adapted to guide the radial exit of respective wire groups differently spaced apart from said crank, whereby said wires are pulled and released, with consequent contraction and expansion of the bladder, further to the rotation of said crank.

4. The device according to claim 3, wherein said guide means comprise a tubular guide with an orderly distribution of holes spaced along said longitudinal axis and through which respective groups of wires radially branch off spreading towards said ventral wall.

5. The device according to claim 4, wherein said guide integrally projects from a protective case housing the rotation of said crank.

6. The device according to claim 3, wherein said motor is embedded in said dorsal wall along with battery means and control means.

7. The device according to claim 1, wherein said outlet opening comprises a syphon ending in an outlet nozzle, the syphon having a cylindrical or frustoconical shape and being arranged in substantially coaxial fashion with said longitudinal axis.

8. The device according to claim 7, wherein said inlet opening comprises a valve, formed by a fracture of said ventral wall extending circumferentially at the base of said syphon.

9. The device according to claim 8, wherein said valve comprises a skirt penetrating said chamber adapted to shut said fracture by internally overlapping an adjacent bladder wall portion, said overlapping and consequent shutting of the fracture and closure of the valve being urged by a contraction of the bladder to which an ejection of the liquid from the chamber responds, whereas in an expanded or unwarped configuration of the bladder the skirt is adapted to become passively lifted freeing the inlet passage of the liquid through said fracture, such condition urging instead the closure of the nozzle of the syphon.

10. The device according to claim 7, wherein steering means of said syphon comprise steering motor means controlling tie-strings that extend over the syphon, embedded in its walls, along respective generatrices.

11. The device according to claim 10, comprising two steering motors controlling respective pairs of tie-strings arranged in two mutually orthogonal diametrical planes.

12. The device according to claim 1, wherein said bladder body is substantially egg-shaped with the major axis coinciding with said longitudinal axis.

13. The device according to claim 1, wherein said soft material has elastic or viscoelastic properties.

14. The device according to claim 13, wherein said material is a polymer having a Young's modulus lower than 100 kPa.

15. The device according to claim 14, wherein the polymer is a silicone polymer.

* * * * *